US011434064B2

(12) United States Patent
Miura

(10) Patent No.: US 11,434,064 B2
(45) Date of Patent: Sep. 6, 2022

(54) HOUSEHOLD THIN PAPER SHEET STORING CONTAINER

(71) Applicant: DAIO PAPER CORPORATION, Shikokuchuo (JP)

(72) Inventor: Akiteru Miura, Shikokuchuo (JP)

(73) Assignee: DAIO PAPER CORPORATION, Shikokuchuo (JP)

( * ) Notice: Subject to any disclaimer, the term of this patent is extended or adjusted under 35 U.S.C. 154(b) by 0 days.

(21) Appl. No.: 17/263,942

(22) PCT Filed: Jul. 9, 2019

(86) PCT No.: PCT/JP2019/027079
§ 371 (c)(1),
(2) Date: Jan. 28, 2021

(87) PCT Pub. No.: WO2020/026718
PCT Pub. Date: Feb. 6, 2020

(65) Prior Publication Data

US 2021/0229896 A1 Jul. 29, 2021

(30) Foreign Application Priority Data

Jul. 31, 2018 (JP) ..... JP2018-143374

(51) Int. Cl.
*B65D 43/22* (2006.01)
*B65D 83/08* (2006.01)
(Continued)

(52) U.S. Cl.
CPC ..... *B65D 83/0805* (2013.01); *A47K 10/421* (2013.01); *A47K 2010/3266* (2013.01); *B65D 43/22* (2013.01); *B65D 2251/1058* (2013.01)

(58) Field of Classification Search
CPC ..... B65D 83/0805
(Continued)

(56) References Cited

U.S. PATENT DOCUMENTS 7,621,401 B2 * 11/2009 Alegre de Miquel ..... A47K 10/421 206/233
2015/0272405 A1 * 10/2015 Powling ..... A47K 10/421 221/63
(Continued)

FOREIGN PATENT DOCUMENTS

JP 2010001046 A 1/2010
JP 2011168341 A 9/2011
(Continued)

OTHER PUBLICATIONS

Japanese Office Action dated Jun. 8, 2021, in connection with corresponding JP Application No. 2018-143374 (6 pp., including machine-generated English translation).
(Continued)

*Primary Examiner* — Gene O Crawford
*Assistant Examiner* — Ayodeji T Ojofeitimi
(74) *Attorney, Agent, or Firm* — Maier & Maier, PLLC

(57) ABSTRACT

A household tissue paper storing container includes a container body that stores household tissue paper and has an outlet through which the household thin paper sheet is taken out, an open/close lid that is pivotably provided to the container body and closes the outlet, a latch that latches the open/close lid in a closed state and that, in response to being unlocked, opens the open/close lid, and a biasing portion that presses the open/close lid in an opening direction. The latch includes an open/close-lid-side latch portion that is provided at the open/close lid, a button moving portion that is a flexible portion provided at the container body, and a button portion that is moved up and down by the button moving portion and has a button-side latch portion that engages the open/close-lid-side latch portion.

7 Claims, 7 Drawing Sheets

(51) Int. Cl.
*A47K 10/42* (2006.01)
*A47K 10/32* (2006.01)

(58) Field of Classification Search
USPC ..... 221/33–63
See application file for complete search history.

(56) References Cited

U.S. PATENT DOCUMENTS

2021/0007560 A1 1/2021 Miura
2021/0024278 A1 1/2021 Miura

FOREIGN PATENT DOCUMENTS

JP 5280743 B2 5/2013
JP 2014065512 A 4/2014
JP 2018-076110 A 5/2018

OTHER PUBLICATIONS

International Preliminary Report on Patentability (IPRP) (and English language translation thereof) dated Feb. 2, 2021 issued in International Application No. PCT/JP2019/027079.
International Search Report (ISR) (and English translation thereof) dated Oct. 15, 2019 issued in International Application No. PCT/JP2019/027079.
Written Opinion dated Oct. 15, 2019 issued in International Application No. PCT/JP2019/027079.
Office Action dated Apr. 28, 2022, in connection with corresponding Russian Application No. 2021102037 (10 pp., including machine-generated English translation).
Search Report dated Mar. 10, 2022 in corresponding European Application No. 19845215.3; 9 pages.
Office Action dated May 5, 2022, in connection with corresponding Chinese Application No. 201980045312.5 (12 pp., including machine-generated English translation).

* cited by examiner

HOUSEHOLD THIN PAPER SHEET STORING CONTAINER

TECHNICAL FIELD

The present invention relates to a household thin paper sheet storing container.

BACKGROUND ART

A storing container of household thin paper sheets such as wet wipes is desired to have an open/close lid that can be opened with a single touch in order to make it easier to open the open/close lid that closes the outlet and to use the household thin paper sheet even when hands are dirty, for example.

For that purpose, there is known a storing container in which an open/close lid biased in an opening direction in advance is pivotably attached to the container body (for example, see JP 5280743 B2). When the open/close lid is closed, a latch portion provided on the open/close lid and a latch portion provided at the container body are engaged with each other. A button pivots when it is pushed, such that these latch portions are disengaged and the open/close lid is opened.

SUMMARY OF INVENTION

Such a household thin paper sheet storing container is configured such that the open/close lid and the button are disengaged when the button pivots. Thus, in order that the button pivots and the open/close lid is opened, it is necessary to push the upper surface of the button at an edge opposite to the latch portion engaged with the open/close lid. It is difficult to open the open/close lid when the other part of the button was pushed.

An object of the present invention is to provide a household thin paper sheet storing container having an open/close lid that can be easily opened in response to push of any part of an upper surface of the button.

One aspect of the invention is a container for housing household tissue paper, which includes a container body that stores household tissue paper inside and has an outlet through which the household tissue paper is taken out, an open/close lid that is pivotably provided to the container body and closes the outlet, a latch that latches the open/close lid in a closed state and that, in response to being unlocked, opens the open/close lid, and a biasing portion that biases the open/close lid in an opening direction. The latch includes an open/close-lid-side latch portion that is provided at the open/close lid, a button moving portion that is a flexible portion provided at the container body, and a button portion that is moved up and down by the button moving portion and has a button-side latch portion that engages the open/close-lid-side latch portion. With this structure, it is possible to provide a household tissue paper storing container having an open-close lid that can be easily opened in response to pushing of any part of the upper surface of the button.

The button moving portion may be a film-shaped portion formed of an elastic material provided on an upper surface of the container body. With this structure, it is possible to provide a household tissue paper storing container having an open-close lid that can be easily opened in response to pushing of any part of the upper surface of the button.

The latch can include a button attachment portion that is surrounded by the button moving portion in a plan view, formed with a hard material, and has a body-side fitting portion having a loop shape and protruding in the upper direction. In addition, the button portion can have the button-side latch portion at a rear edge, an upper surface portion that forms an upper surface, and a button-side fitting portion that protrudes from the upper surface portion in a lower direction and fits to the body-side fitting portion. With this structure, it is possible to easily fix the button portion onto the button moving portion.

The button portion may have a front wall that is on a front side of the button-side fitting portion and that protrudes from the upper surface portion in a lower direction. With this structure, it is possible to attach the button portion onto the button moving portion more stably.

The front wall may have an inclined surface on a front side in a vicinity of a lower edge of the front wall, the inclined surface being inclined rearward to a lower part. With this structure, it is possible to easily disengage the open/close-lid-side latch portion and the button-side latch portion in response to pushing of the button portion.

The outlet may be formed as an outlet portion that is a flexible portion formed of an elastic material provided on an upper surface of the container body, and the outlet may be continuously formed to the button moving portion and the outlet portion. With this structure, it is possible to easily manufacture the household tissue paper storing container.

DETAILED DESCRIPTION

Hereinafter, the container for housing household tissue paper 100 as an embodiment of the present invention is described in detail with reference to FIG. 1 to FIG. 8. However, the scope of the invention is not limited to the illustrated examples.

Figure 1:
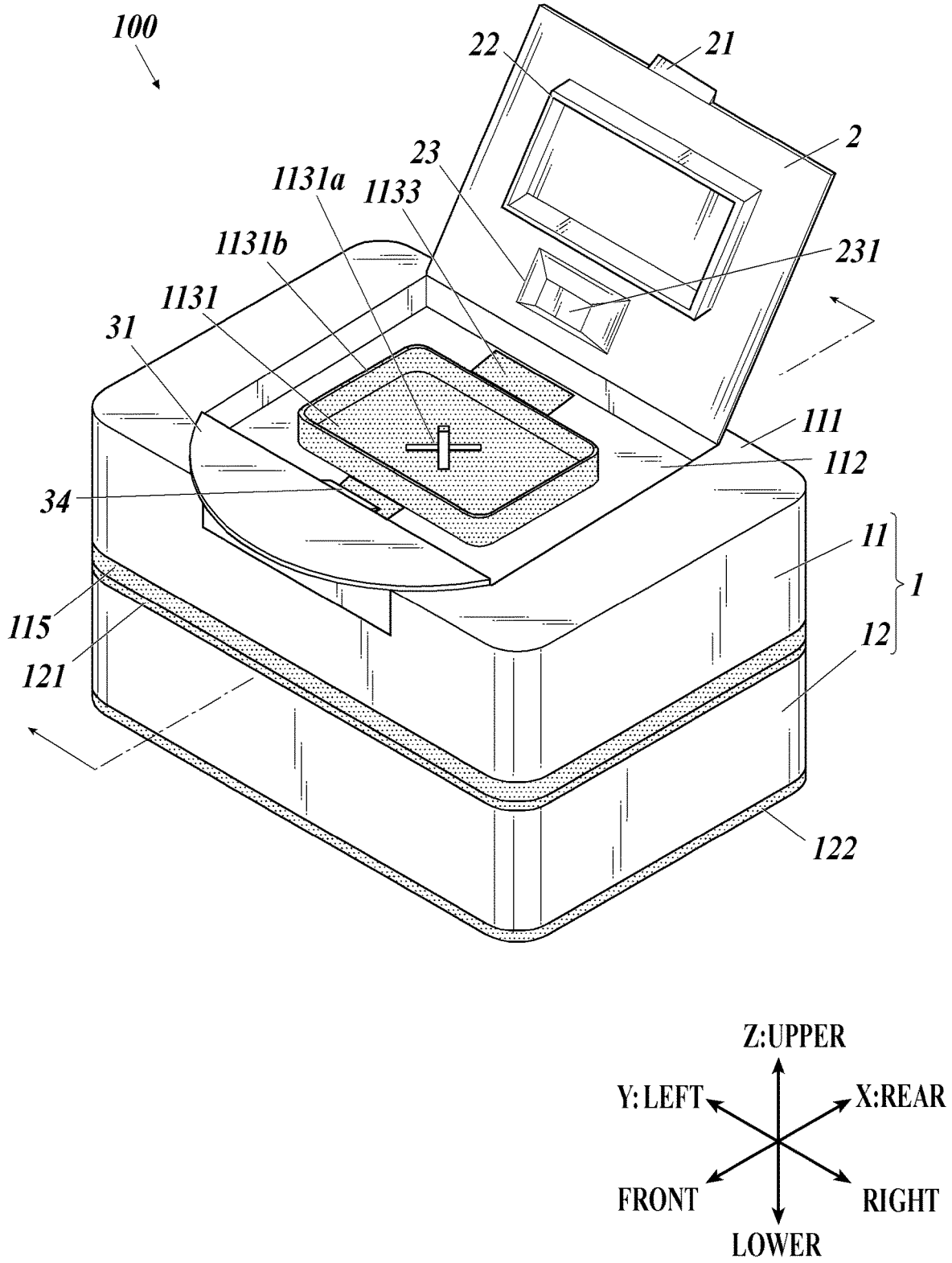
FIG. 1 is a perspective view of a household thin paper sheet storing container according to an embodiment viewed diagonally from the front. Shaded areas represent portions formed of an elastic material. This also applies to other figures.

In the following description, an X-axis, Y-axis, Z-axis, front-rear direction, left-right direction, and upper-lower direction are defined as shown in FIG. 1. That is, the side of the container for housing household tissue paper 100 on which the open/close lid 2 is provided and the side opposite thereto are referred to as "upper" and "lower", respectively. The side where a container body 1 and the open/close lid 2 are connected and the side opposite thereto are referred to as "rear" and "front", respectively. The right-hand side and the left-hand side when one is facing toward the rear are referred to as "right" and "left", respectively. The axis along the front-rear direction is referred to as an X axis, the axis along the left-right direction is referred to as a Y axis, and the axis along the upper-lower direction is referred to as a Z axis.

Configuration of Embodiment

{Overall Configuration}

As shown in FIG. 1 to FIG. 4, the household thin paper sheet storing container 100 includes a container body 1 that has an outlet 1131*a* through which the inside household thin paper sheet is taken out, an open/close lid 2 that covers the outlet 1131*a* and is connected to the container body 1 so as to be freely opened and closed, and a button portion 3 that is provided on the container body 1 and is used in opening and closing the open/close lid 2. The container body 1 has a housing space S that is formed to store the household thin paper sheet P inside.

The container body 1 and the open/close lid 2 can be integrally formed by injection molding (double molding).

{Household Tissue Paper}

The household tissue paper P is, for example, so-called pop-up type sheets in which small wet sheets, wet tissues, or the like are folded and stacked in alternating directions such that, when one wet sheet, wet tissue, or the like is pulled out, the next one is also pulled out. Another example of the household tissue paper P is a roll sheet that is a long wet sheet, wet tissue, or the like that is wound into a roll and has perforations at regular intervals in the length direction so as to be cut along the perforations and used.

{Container Body}

As shown in FIG. 1, the container body 1 as a whole is formed in a substantially rectangular parallelepiped shape that is longer in the Y direction than in the X and Z directions. The container body 1 is vertically divided into two parts almost in the middle in the Z direction, one being an upper container body 11 constituting the upper side of the container body 1 and the other being a lower container body 12 constituting the lower side of the container body 1. The upper container body 11 and the lower container body 12 are connected to each other on the rear side of the container body 1.

The upper container body 11 and the lower container body 12 can be integrally formed by injection molding (double molding).

The dimensions of the container body 1 as a whole are preferably 60 mm to 150 mm, more preferably 80 mm to 100 mm in the X direction, preferably 80 mm to 200 mm, more preferably 145 mm to 165 mm in the Y direction, and preferably 30 mm to 100 mm, more preferably 50 mm to 70 mm in the Z direction.

The thickness of each surface is preferably 0.5 mm to 3 mm, more preferably 1 mm to 2 mm.

With such dimensions and thickness, it is possible to achieve high molding efficiency and strength that does not cause any problems in actual use.

Figure 4:
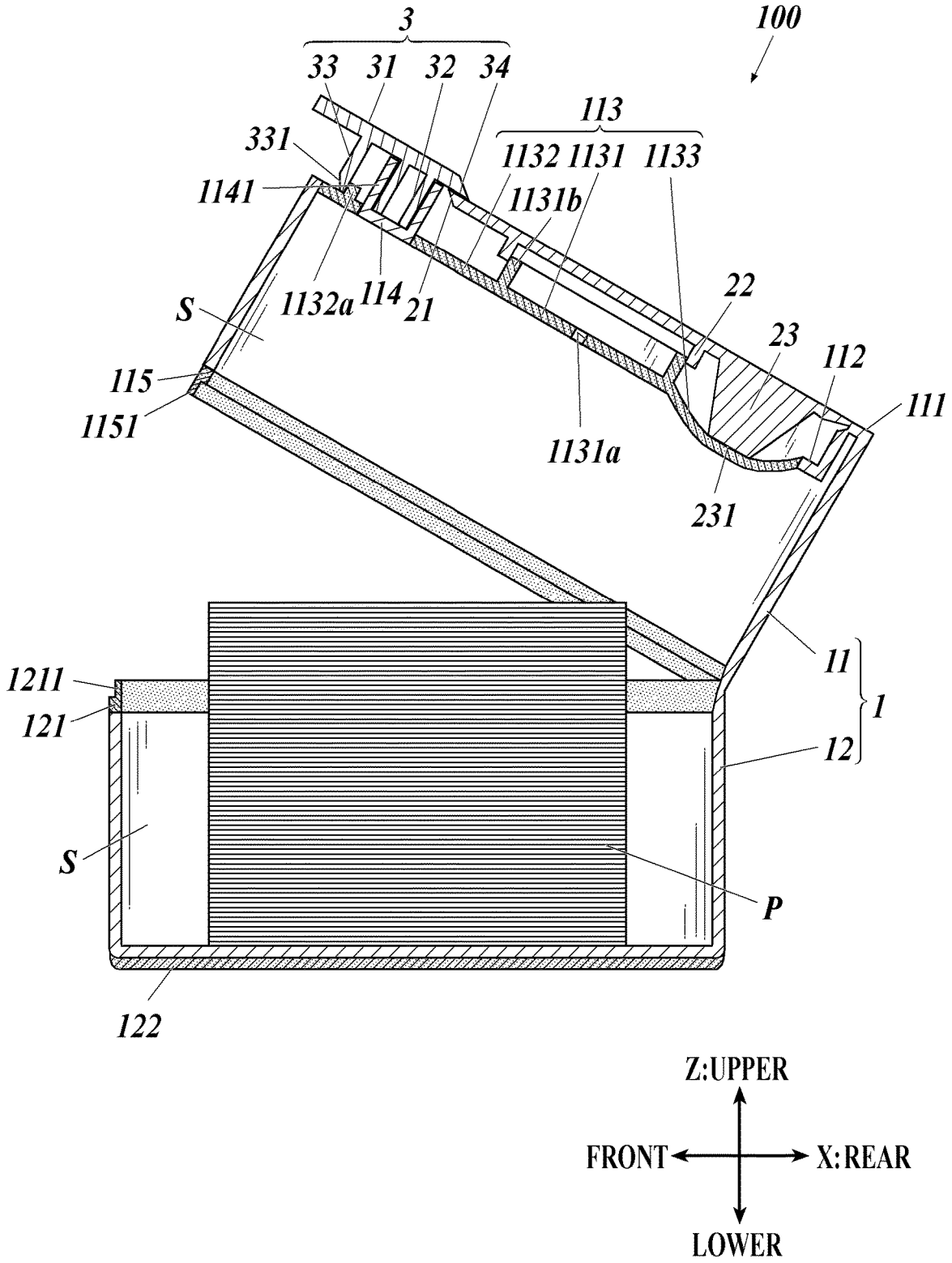
FIG. 4 is a sectional view showing a portion corresponding to FIG. 2 when a container body is in an open state.

As shown in FIG. 4, the container body 1 can expose the internal housing space S to the outside in response to pivoting of the upper container body 11 in the upper direction around a pivot point on the rear side of the container body 1. The upper container body 11 and the lower container body 12 are connected at the pivot point.

Figure 2:
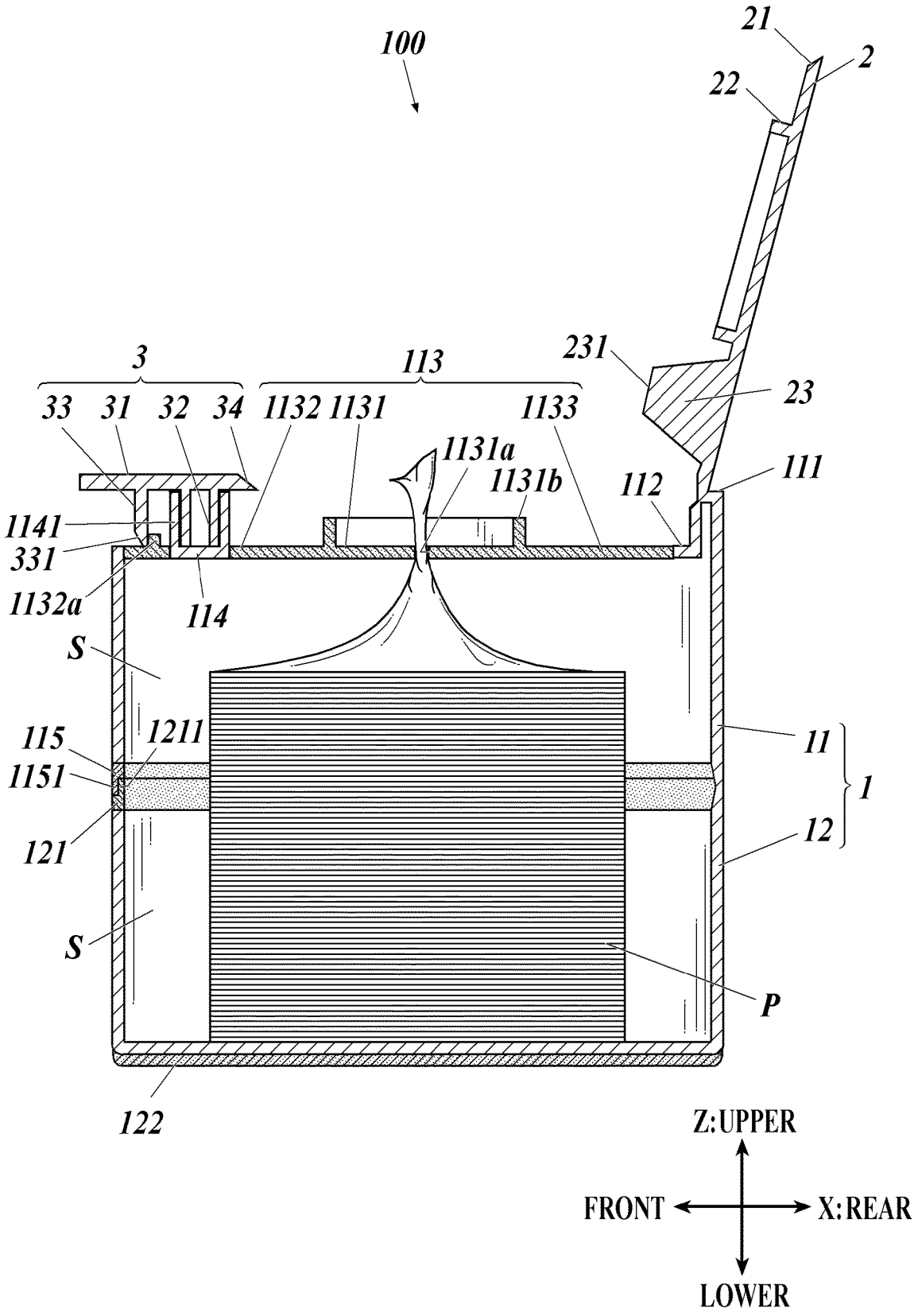
FIG. 2 is a sectional view of FIG. 1 cut through a middle portion in Y direction.
Figure 3:
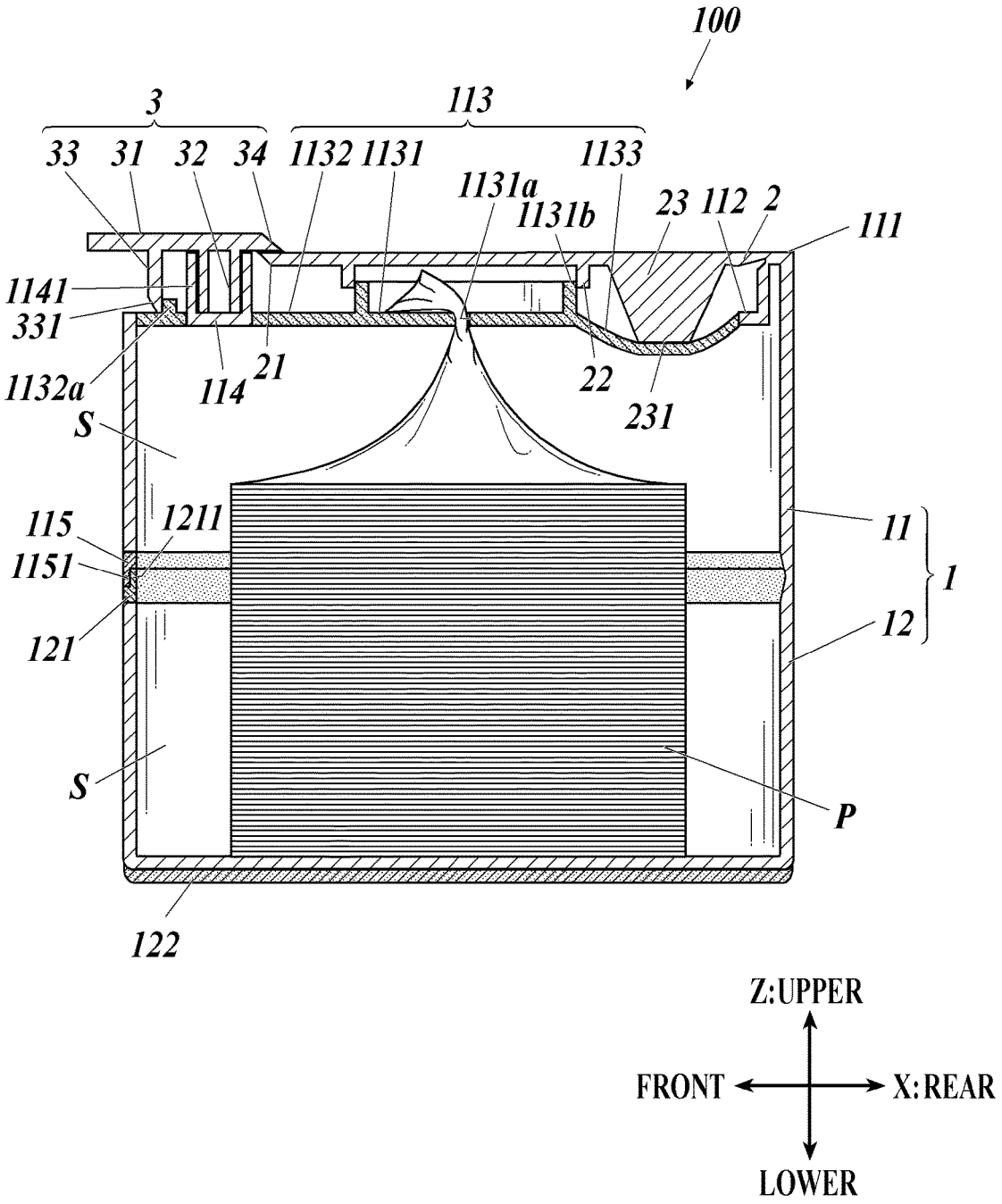
FIG. 3 is a sectional view showing a portion corresponding to FIG. 2 when an open/close lid is in a closing state.

As shown in FIG. 2 to FIG. 4, a connecting portion between the upper container body 11 and the lower container body 12 on the rear side of the container body 1 is formed so as to be thinner than other portions of the container body 1. Therefore, the rear surface of the container body can be readily bent at the connecting portion. This makes it easy to pivot the upper container body 11 with respect to the lower container body 12 around the connecting portion as a pivot point.

Alternatively, though productivity is reduced, the upper container body 11 and the lower container body 12 can be formed separately and connected pivotally by using a hinge or the like.

The container body 1 is divided into the upper container body 11 and the lower container body 12 almost in the middle in the Z direction in the drawings, but is more preferably divided at a position above the middle in the Z direction. This reduces the possibility that an end seal portion(s) of the package is pinched when the container is closed, and thereby makes it easier to refill the household thin paper sheet P to be stored in the container body 1 while being covered with a predetermined package.

(Upper Container Body)

As shown in FIG. 1 to FIG. 5, the upper container body 11 is formed in a substantially rectangular parallelepiped shape having a lower surface as an opening and an upper surface as a top surface portion 111, and has a recessed portion 112 in a sunken recessed shape formed near the middle of the top surface portion 111.

In the recessed portion 112, there is formed an elastic portion 113 formed of an elastic material and a button attachment portion 114 to which the button portion 3 is attached.

Around the opening lower surface, there is formed an upper sealing portion 115 that fits to a lower sealing portion 121 of the lower container body 12 described later.

(Recessed Portion)

As shown in FIG. 1 to FIG. 5, the recessed portion 112 is a portion that is formed near the middle of the upper surface of the upper container body 11 in a plan view and formed toward the lower direction to form a recessed shape. FIG. 1 to FIG. 5 show an example in which the recessed portion 112 has a substantially rectangular shape reaching the front edge of the upper container body 11 in a plan view. However, the specific shape of the recessed portion 112 is not limited to this.

The recessed portion 112 preferably has a depth of 5 mm to 20 mm as viewed from the top surface portion 111. The size of the recessed portion 112 in a plan view is not particularly limited as long as the elastic portion 113 can be formed inside, but is preferably 40 mm to 80 mm in the X direction (the short side direction of the top surface portion 111) and 40 mm to 120 mm in the Y direction (the long side direction of the top surface portion 111).

(Elastic Portion)

The elastic portion 113 is a flexible portion formed of a predetermined elastic material in the recessed portion 112 at the upper surface of the upper container body 11, and includes an outlet portion 1131, a button moving portion 1132, and an open/close lid biasing portion 1133.

The elastic material forming the elastic portion 113 is, for example, a material having elasticity such as silicon rubber or a thermoplastic elastomer of a styrene-butadiene type, polyester type, polyethylene type, urethane type, or the like, and preferably has a hardness of 20 to 90. The hardness is measured based on JIS K 6253 (type A durometer).

The hardness of the elastic material less than the above range is not desirable from the viewpoint that the elastic materials are too soft to be molded so as to result in poor molding efficiency, and that the button moving portion 1132 does not bias the button portion 3 sufficiently and the open/close lid biasing portion 1133 does not bias the open/close lid 2 described later sufficiently.

The hardness of the elastic material larger than the above range is not desirable from the viewpoint that the button moving portion 1132 biases the button portion 3 too much and that the open/close lid biasing portion 1133 biases the open/close lid 2 described later too much. Furthermore, the outlet portion 1131 where an outlet 1131*a* for taking out the household thin paper sheet P described later is formed is so hard that the sheet receives too much resistance to be easily taken out one by one, and that one cannot easily put one's finger inside the container in pulling out the sheet.

(Outlet Portion)

As shown in FIG. 1 to FIG. 5, the outlet portion 1131 is a portion formed of an elastic material formed near the middle portion of the recessed portion 112 in a plan view, has the outlet 1131*a* for taking out the household thin paper sheet P in the middle, and has a body-side sealing loop 1131*b* in a loop-shaped projection protruding in the upper direction at its periphery.

The outlet portion 1131 is desirably formed as a film having a thickness of 0.5 mm to 2 mm in the Z direction, except where the body-side sealing loop 1131*b* of the elastic material is formed.

(Outlet)

The outlet 1131*a* is a hole that is formed in the middle of the outlet portion 1131 in a plan view and connect to the housing space S.

Figure 5:
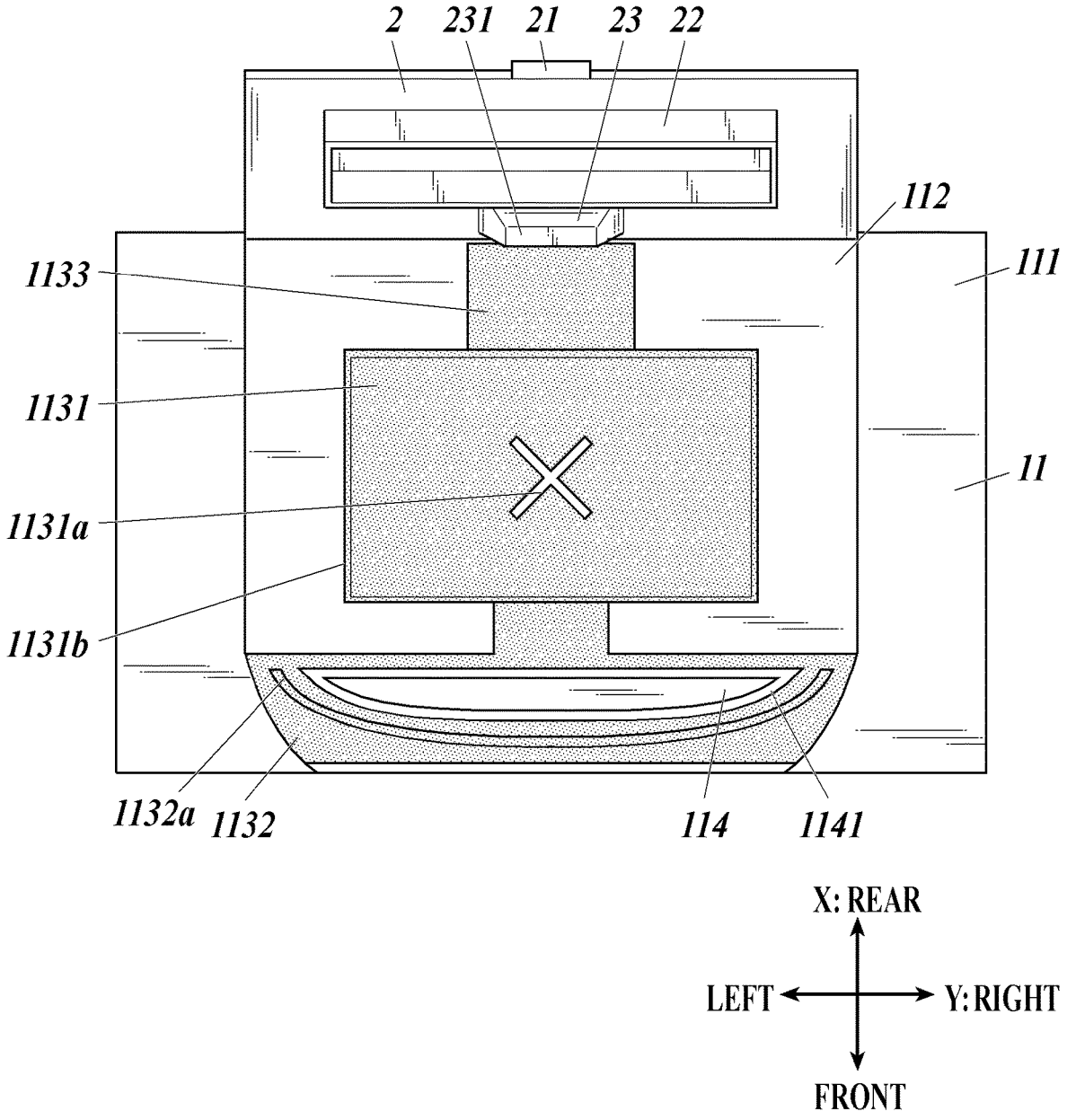
FIG. 5 is a plan view of the household thin paper sheet storing container according to the embodiment without a button portion.

The outlet 1131*a* is formed by making two intersecting cuts in FIG. 1 and FIG. 5, but the present invention is not limited to this, and the number of cuts may be more than two. For example, three cuts may be made so as to connect respective vertices of a right triangle to the center of gravity of the right triangle.

The outlet portion 1131, formed of the elastic material in the periphery of the outlet 1131*a*, can apply appropriate resistance to the household thin paper sheet P. As a result, when a household thin paper sheet P in the housing space S is pulled out, the next household thin paper sheet P is held by the outlet 1131*a*. Furthermore, when the household thin paper sheet P is a roll sheet, the outlet 1131*a* can cut the household thin paper sheet P at its perforations provided for cutting.

(Body-Side Sealing Loop)

As shown in FIG. 1, the body-side sealing loop 1131*b* is a loop-shaped projection protruding in the upper direction and surrounding the outlet 1131*a*. As shown in FIG. 3 and FIG. 4, the outer peripheral surface of the body-side sealing loop 113 is formed so as to fit to the inner peripheral surface of the open/close-lid-side sealing loop 22 formed on the open/close lid 2 as described later.

(Button Moving Portion)

As shown in FIG. 2 to FIG. 5, the button moving portion 1132 is a flexible film-shaped portion formed of an elastic material in front of the outlet portion 1131 near the front edge of the recessed portion 112. The middle of the button moving portion 1132 in the Y direction is connected to the outlet portion 1131. The outlet portion 1131 and the button moving portion 1132 can be connected to each other at any position. For example, the left side of the front edge of the outlet portion 1131 may be connected to the left side of the rear edge of the button moving portion 1132, and the right side of the front edge of the outlet portion 1131 may be connected to the right side of the rear edge of the button moving portion 1132.

As shown in FIG. 5, the button moving portion 1132 is formed in a loop shape in a plan view so as to be provided with a button attachment portion 114 in the middle.

The button moving portion 1132 is desirably formed of an elastic material in a film shape having a thickness in the Z direction of 0.5 mm to 2 mm. The button moving portion 1132 may have any shape and size in a plan view as long as the button portion 3 described below can be attached thereto with the button attachment portion 114. However, as shown in FIG. 5, the button moving portion 1132 is desirably formed so as to cover the entire recessed portion 112 in the Y direction near the front edge of the recessed portion 112.

(Guide)

As shown in FIG. 2 to FIG. 5, the button moving portion 1132 has a guide 1132*a* on a front side of the button attachment portion 114. When the button portion 3 is attached to the button attachment portion 114, the guide 1132*a* is along the rear surface side of the front wall 33 of the button portion 3. The guide 1132*a* is a projection protruding from the upper surface of the button moving portion 1132 in the upper direction. The front surface side of the guide 1132*a* contacts the rear surface side of the front wall 33 of the button portion 3, so that the button portion 3 does not easily shift.

The guide 1132*a* is desirably formed so as to protrude from the upper surface of the button moving portion 1132 by 0.1 mm to 1 mm to the upper direction.

(Open/Close Lid Biasing Portion)

As shown in FIG. 1 to FIG. 5, the open/close lid biasing portion 1133 is a flexible film-shaped portion formed of an elastic material near the rear edge of the recessed portion 112. The open/close lid biasing portion 1133 is formed behind the outlet portion 1131 and connected to the middle of the outlet portion 1131 in the Y direction.

The open/close lid biasing portion 1133 is desirably formed with an elastic material in a film shape having a thickness in the Z direction of 0.5 mm to 2 mm. The open/close lid biasing portion 1133 may have any shape and size in a plan view as long as contacting an entire contact surface 231 on the lower surface of a biasing projection 23 formed on the open/close lid 2 described later, but is preferably 5 mm to 20 mm in the X direction (the short side direction of the top surface portion 111) and 10 mm to 100 mm in the Y direction (the long side direction of the top surface portion 111).

(Button Attachment Portion)

As shown in FIG. 2 to FIG. 5, the button attachment portion 114 is a portion surrounded by the button moving portion 1132 in a plan view, formed with a hard material described later, and has a body-side fitting portion 1141 in a loop shape protruding in an upper direction.

(Body-Side Fitting Portion)

As shown in FIG. 5, the body-side fitting portion 1141 has a loop shape having a curved part on the front side and a linear part on the rear side in a plan view and protrudes in the upper direction. The inner periphery of the body-side fitting portion 1141 is formed to be the same as or slightly larger than the outer periphery of the button-side fitting portion 32 formed on the button portion 3 described later. By inserting the button-side fitting portion 32 into the body-side fitting portion 1141 from above, the button portion 3 can be attached to the button attachment portion 114.

Alternatively, the outer periphery of the body-side fitting portion 1141 may be formed to be the same as or slightly smaller than the inner periphery of the button-side fitting portion 32 formed on the button portion 3 described later. In such cases, by inserting the body-side fitting portion 1141 into the button-side fitting portion 32 from the lower side, the button portion 3 can be attached to the button attachment portion 114.

As shown in FIG. 2 to FIG. 4, the height of the body-side fitting portion 1141 in the Z direction is desirably the same everywhere, and is desirably almost the same as the depth of the recessed portion 112 in the Z direction.

(Upper Sealing Portion)

As shown in FIG. 1 to FIG. 4, the upper sealing portion 115 is formed around the opening at the lower part of the upper container body 11 except for the rear side of the opening where the upper container body 11 and the lower container body 12 are connected to each other. Only the outer periphery of the lower edge of the upper sealing portion 115 protrudes to form an upper protrusion 1151. The inner peripheral surface of the upper protrusion 1151 is formed so as to fit to the outer peripheral surface of the lower protrusion 1211 of the lower sealing portion 121 formed in the lower container body 12 as described later.

The sealing portion 115 is formed such that the upper protrusion 1151 has a dimension in the upper-lower direction of preferably 0.5 mm to 5 mm, more preferably 1 mm to 3 mm.

The upper sealing portion 115 is desirably formed of the above-described elastic material.

(Material of Upper Container Body)

As described above, the upper container body has the elastic portion 113 and the upper sealing portion 115 formed of the elastic material. The other portions of the upper container body are formed of a hard material that is harder than the elastic material. As the hard material, for example, polyethylene, polypropylene and the like can be used. The hardness is measured with the same method as the one described regarding the elastic material.

It is desired that the portion formed of the elastic material and the portion formed of the hard material are integrally formed by injection molding (double molding).

(Lower Container Body)

As shown in FIG. 1 to FIG. 4, the lower container body 12 is formed in a substantially rectangular parallelepiped shape having an opening upper surface. Around the opening upper surface, there is formed a lower sealing portion 121 that fits to the upper sealing portion 115 of the upper container body 11. A nonslip portion 122 is formed on the lower surface.

(Lower Sealing Portion)

As shown in FIG. 1 to FIG. 4, the lower sealing portion 121 is formed around the opening on the upper part of the lower container body 12 except for the rear side of the opening where the lower container body 12 and the upper container body 11 are connected to each other. Only the inner peripheral portion of the upper edge of the lower sealing portion 121 protrudes to form a lower protrusion 1211. The outer peripheral surface of the lower protrusion 1211 is formed so as to fit to the inner peripheral surface of the upper protrusion 1151 of the upper sealing portion 115 formed in the upper container body 11.

The lower sealing portion 121 is formed such that the lower protrusion 1211 has a dimension in the upper-lower direction of preferably 0.5 mm to 5 mm, more preferably 1 mm to 3 mm.

Alternatively, only the inner peripheral side of the upper protrusion 1151 of the upper sealing portion 115 and only the outer peripheral side of the lower protrusion 1211 of the lower sealing portion 121 may be each formed to protrude, such that the outer peripheral surface of the upper protrusion 1151 fits to the inner peripheral surface of the lower protrusion 1211.

Alternatively, the middle of the upper protrusion 1151 between the inner and outer peripheral sides and both of the inner and outer peripheral sides of the lower protrusion 1121 may be each formed to protrude, such that the upper protrusion 1151 fits to a recessed portion between the lower protrusions 1211. Conversely, both of the inner and outer peripheral sides of the upper protrusion 1151 and the middle of the lower protrusion 1211 between the inner and outer peripheral sides may be each formed to protrude, such that the lower protrusion 1211 fits to a recessed portion between the upper protrusions 1151.

(Nonslip Portion)

The nonslip portion 122 is formed on the lower surface of the lower container body 12 to cause the household thin paper sheet storing container 100 less likely to slip when it is left. The nonslip portion 122 is a portion formed of an elastic material with other portions integrally.

(Material of Lower Container Body)

The lower container body 12 has the lower sealing portion 121 and the nonslip portion 122 that are formed of an elastic material similar to the one used in the upper container body 11, and the other portions are formed of a hard material similar to the one used in the upper container body 11.

It is desired that they are integrally formed by injection molding (double molding).

{Open/Close Lid}

As shown in FIG. 1 to FIG. 5, the open/close lid 2 is a flat and substantially rectangular member that is pivotally connected to the rear side of the recessed portion 111 of the upper container body 11, has an open/close-lid-side latch portion 21 on the front side in a closing state, and has an open/close-lid-side sealing loop 22 and the biasing projection 23 on the lower surface side.

As shown in FIG. 1 to FIG. 5, the shape of the open/close lid 2 in a plan view in the closing state is formed to be substantially the same as the shape in a plan view of the recessed portion 112 of the upper container body 11 without the portion where the button portion 3 described later is formed. Therefore, the open/close lid 2 can fit to the recessed portion 112 and is on the same surface as the top surface portion 111 when closed.

(Open/Close-Lid-Side Latch Portion)

As shown in FIG. 1 to FIG. 5, the open/close-lid-side latch portion 21 is a hook-shaped portion protruding from the open/close lid 2 toward the front. The open/close-lid-side latch portion 21 engages with a button-side latch portion 34 formed at the button portion 3 described later, and the open/close lid is latched in the closing state. When a user pushes the button portion 3 described later, the open/close-lid-side latch portion 21 and the button-side latch portion 34 are disengaged, and the open/close lid 2 is opened because of the biasing force caused by the open/close lid biasing portion 1133 of the upper container body 11 and the biasing projection 23 formed on the open/close lid 2.

The shape of the open/close-lid-side latch portion 21 is not limited to have a hook shape as shown in FIG. 1 to FIG. 5, but may have any shape as long as the open/close-lid-side latch portion 21 engages with the button-side latch portion 34 to latch the open/close lid in the closing state, and as long as, when a user pushes the button portion 3, the open/close-lid-side latch portion 21 and the button-side latch portion 34 are disengaged.

(Open/Close-Lid-Side Sealing Loop)

As shown in FIG. 2 to FIG. 5, the open/close-lid-side sealing loop 22 is a loop-shaped projection protruding in the lower direction, and formed in the middle of the lower surface of the open/close lid 2 in the closing state. As shown in FIG. 3 and FIG. 4, the inner peripheral surface of the open/close-lid-side sealing loop 22 is formed so as to be fit to the outer peripheral surface of the body-side sealing loop 1131*b* formed on the upper container body 11.

(Biasing Projection)

As shown in FIG. 1 to FIG. 5, the biasing projection 23 is formed on the lower surface side of the open/close lid 2. The biasing projection 23 is formed in the middle in the Y direction and between the open/close lid-side sealing loop 22 and the connection portion where the open/close lid 2 and the upper container body 11 are connected. That is, the biasing projection 23 is a projection protruding in a lower direction when the open/close lid 2 is closed, and is formed at a position facing the open/close lid biasing portion 1133 formed in the upper container body 11 when the open/close lid 2 is closed.

As shown in FIG. 3 and FIG. 4, the protruding length of the formed biasing projection 23 is slightly than the distance between the lower surface of the open/close lid 2 and the open/close lid biasing portion 1133 when the open/close lid 2 is closed. The biasing projection 23 is formed so as to push the open/close lid biasing portion 1133 in the lower direction when the open/close lid 2 is closed.

Specifically, the biasing projection 23 is preferably formed longer than the distance between the lower surface of the open/close lid 2 and the open/close lid biasing portion 1133 by a length of 0.3 mm to 1 mm in the Z direction, and is preferably formed so as to push the open/close lid biasing portion 1133 in the lower direction by the length when the open/close lid 2 is closed.

(Contact Surface)

The biasing projection 23 has the contact surface 231 that has a flat lower end when the open/close lid 2 is closed and comes into contact with the open/close lid biasing portion 1133. The contact surface 231 is formed so that the entire contact surface 231 comes into contact with the open/close lid biasing portion 1133 when the open/close lid 2 is closed. The contact surface 231 is desirably formed so as to have an area of 0.015 $cm^2$ to 2 $cm^2$.

The biasing projection 23 illustrated in FIG. 1 to FIG. 5 has a quadrangular pyramid shape having rectangular upper and lower bases. However, the shape of the biasing projection 23 is not limited to this, as long as the contact surface 231 is formed thereon. For example, it may be formed in a truncated cone shape or a rectangular parallelepiped shape.

(Material of Open/Close Lid)

As shown in FIG. 1 to FIG. 5, the entire open/close lid 2 is formed of a hard material similar to the one used in the upper container body 11.

(Button Portion)

As shown in FIG. 1 to FIG. 4 and FIG. 6, the button portion 3 is formed in the shape of a button having the button-side latch portion 34 that engages with the open/close-lid-side latch portion 21 of the open/close lid 2. The open/close lid 2 is thereby latched in the closing state. When a user pushes the button portion 3, the button-side latch portion 34 and the open/close-lid-side latch portion 21 are disengaged, and the open/close lid 2 is opened.

As described above, preferably, the entire household thin paper sheet storing container 100 is integrally formed by double molding except for the button portion 3. The button portion 3 is formed independently (as a separate member) using a hard material similar to the one used for the container body 1 and the like, and then is fixed on the upper side of the button moving portion 1132 using the button attachment portion 114.

As shown in FIG. 1 to FIG. 4 and FIG. 6, the button portion 3 is composed of an upper surface portion 31 as an upper surface, a button-side fitting portion 32 that protrudes from the upper surface portion 31 in the lower direction, a front wall 33, and the above-mentioned button-side latch portion 34.

(Upper Surface Portion)

As shown in FIG. 1 to FIG. 4 and FIG. 6, the upper surface portion 31 forms an upper surface of the button portion 3 and has a linear part on the rear side and a curved part on the front side in a plan view. Except for a vicinity of the front edge, the upper surface portion 31 is formed so as to have substantially the same shape as the shape in a plan view of the portion near the front edge of the recessed portion 112. The portion near the front edge of the upper surface portion 31 protrudes from the recessed portion 112 toward the front.

As shown in FIG. 3 and FIG. 4, the upper surface portion 31 is formed so that the lower surface side thereof is located substantially at the same height as the top surface portion 111 of the upper container body 11 when the button portion 3 is not pushed from above.

The size of the upper surface portion 31 depends on the size of the portion of the recessed portion 112 that is not covered by the open/close lid 2, but is desirably 10 mm to 30 mm at the longest portion in the X direction and 30 mm to 100 mm at the longest portion in the Y direction.

(Button-Side Fitting Portion)

As shown in FIG. 2 to FIG. 4 and FIG. 6, the button-side fitting portion 32 has a loop shape having a curved part on the front side and a linear part on the rear side in a bottom view and protrudes in the lower direction. The outer periphery of the button-side fitting portion 32 is formed to be the same as or slightly smaller than the inner periphery of the body-side fitting portion 1141 described above. By inserting the button-side fitting portion 32 into the body-side fitting portion 1141 from above, the button portion 3 can be attached to the button attachment portion 114.

Alternatively, the inner periphery of the button-side fitting portion 32 may be formed to be the same as or slightly larger than the outer periphery of the body-side fitting portion 1141 described above. In such cases, by inserting the body-side fitting portion 1141 into the button-side fitting portion 32 from the lower side, the button portion 3 can be attached to the button attachment portion 114.

The height of the button-side fitting portion 32 is substantially the same everywhere, and is formed to be substantially the same as the body-side fitting portion 1141.

Furthermore, although not shown in the drawings, a connecting portion that connects the front surface side and the rear surface side of the button-side fitting portion 32 in the front-rear direction may be formed in order to improve the strength of the button-side fitting portion 32.

(Front Wall)

As shown in FIG. 2 to FIG. 4 and FIG. 6, the front wall 33 is in front of the button-side fitting portion 32, has a curved shape along the front surface side of the button-side fitting portion 32 in a bottom view, and protrudes in the lower direction. The entire front wall 33 is formed so as to have substantially the same height as the button-side fitting portion 32. The front wall 33 has an inclined surface 331 at its lower edge.

(Inclined Surface)

As shown in FIG. 2 to FIG. 4 and FIG. 6, the inclined surface 331 is formed near the lower edge of the front wall 33 and is a portion formed so that the front side thereof is inclined. The inclined surface 331 is formed in the vicinity of the entire lower edge of the front wall 33.

(Button-Side Latch Portion)

As shown in FIG. 1 to FIG. 4 and FIG. 6, the button-side latch portion 34 is a hook-shaped portion of the button portion 3 protruding to the rear direction. The button-side latch portion 34 engages with the open/close-lid-side latch portion 21 of the open/close lid 2, and the open/close lid is latched in the closing state. When a user pushes the button portion 3, the button-side latch portion 34 and the open/close-lid-side latch portion 21 are disengaged, and the open/close lid 2 is opened due to the biasing force by the open/close lid biasing portion 1133 of the upper container body 11 and the biasing projection 23 formed on the open/close lid 2.

Figure 6:
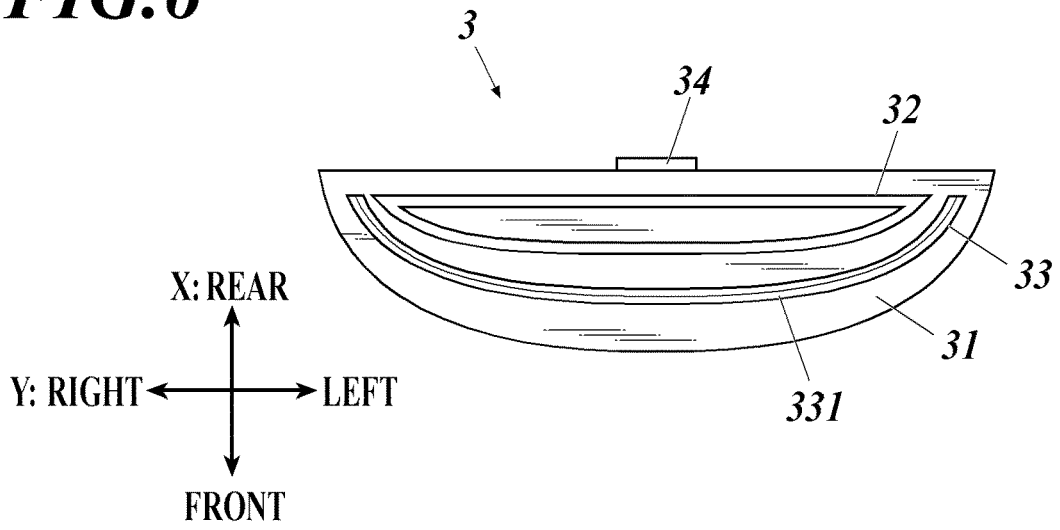
FIG. 6 is a bottom view of the button portion.

As shown in FIG. 1 and FIG. 6, the button-side latch portion 34 is formed so as to protrude from the middle in the Y direction of the upper edge of the rear part of the button portion 3 to the rear direction.

The shape of the button-side latch portion 34 is not limited to be a hook shape as shown in the drawings, but may be any shape as long as the button-side latch portion 34 engages with the open/close-lid-side latch portion 21 to latch the open/close lid 2 in the closing state, and as long as, when a user pushes the button portion 3, the button-side latch portion 34 and the open/close-lid-side latch portion 21 are disengaged.

For example, the button-side latch portion 34 may be a hole into which the open/close lid-side latch portion 21 is inserted.

Effect from Embodiment

According to the household thin paper sheet storing container 100 according to the embodiment, the button portion 3 is attached to the button attachment portion 114 supported by the button moving portion 1132 made of an elastic material and is located on the button moving portion 1132. As a result, when a user pushes the upper surface portion 31 of the button portion 3 from above when the open/close lid 2 is closed, the button moving portion 1132 is distorted in the lower direction regardless of the pushed position, and the button portion 3 thereby moves in the lower direction.

Because the button portion 34 of the button portion 3 and the open/close-lid-side latch portion 21 of the open/close lid 2 are engaged, in response to the movement of the button portion 3 in the lower direction, the open/close lid 2 is also pushed in the lower direction. However, a biasing force that biases the open/close lid 2 in the upper direction and caused by the biasing projection 23 of the open/close lid 2 and the open/close lid biasing portion 1133 of the upper container body 11 becomes stronger as the open/close lid 2 moves in the lower direction.

Therefore, when the button portion 3 is pushed in to a certain extent, the open/close lid 2 moves in the lower direction in response to this, such that the biasing force on the open/close lid 2 in the upper direction becomes stronger. Because the open/close lid 2 and the button portion 3 are engaged only at the open/close-lid-side latch portion 21 and the button-side latch portion 34, when the biasing force on the open/close lid 2 becomes strong, they are disengaged and the open/close lid 2 is opened.

Therefore, according to the present embodiment, the open/close lid 2 can be easily opened in response to push of any part of the upper surface of the button portion 3.

Furthermore, because the button portion 3 has the button-side fitting portion 32 and the upper container body 11 has the button attachment portion 114 having the body-side fitting portion 1141, the button portion 3 can be easily fixed to the container body 1.

Furthermore, the button portion 3 can be attached more stably when having the front wall 33 than when supported only by the button-side fitting portion 32.

Also, because the inclined surface 331 is formed on the front surface near the lower edge of the front wall 33, the button portion 3 easily inclined forward in response to the strong biasing force in the upper direction, from the open/close lid 2 to the button portion 34 of the button portion 3. As a result, the open/close-lid-side latch portion 21 and the button-side latch portion 34 can be easily disengaged.

Furthermore, according to the household thin paper sheet storing container 100 according to the embodiment, the open/close lid 2 can be biased in the opening direction, as long as the upper container body 11 is provided with the open/close lid biasing portion 1133 and the open/close lid 2 is provided with the biasing projection 23.

It is not necessary to provide a further member in such a case, because the open/close lid biasing portion 1133 can be integrally formed with the upper container body 11, and the biasing projection 23 can be integrally formed with the open/close lid 2. Therefore, the biasing mechanism against the open/close lid 2 can be easily configured, and the production efficiency is improved as compared with the case where a separate leaf spring or the like is used.

Furthermore, when a spring-shaped biasing means standing toward the upper direction is provided as in the invention described in Patent Document 1, for example, such a spring-like portion is easily deteriorated by being repeatedly bent and stretched each time when the open/close lid is opened and closed. Then, the biasing force on the open/close lid tends to be weakened quickly. When the biasing force on the open/close lid is weakened to a certain extent, it is not possible to open it with a single touch.

On the other hand, according to the present embodiment, the open/close lid biasing portion 1133 in a film shape formed of the elastic material is pushed by the biasing projection 23 to generate the biasing force on the open/close lid 2. Therefore, the portion formed of the elastic material is deformed only slightly and is not easily deteriorated, so that the biasing force on the open/close lid is not easily weakened.

Furthermore, because the biasing projection 23 is provided with the contact surface 231, it is possible to prevent excessive pressure from being applied to the part of the open/close lid biasing portion 1133 that contacts the biasing projection 23, and to reduce the risk that the open/close lid biasing portion 1133 is damaged.

Furthermore, the open/close lid biasing portion 1133 and the biasing projection 23 are both formed near a pivot point on the rear side of the container around which the open/close lid 2 pivots. As a result, the open/close lid 2 is biased with a stronger force and can be easily opened.

Furthermore, according to the present embodiment, it is possible to form, with a method such as double molding, an elastic portion 113 continuously including the outlet portion 1131 used to take out the household thin paper sheet P, the button moving portion 1132 used to move the button portion 3, and the open/close lid biasing portion 1133 used to bias the open/close lid 2. From this point as well, the productivity of the household thin paper sheet storing container can be preferably improved.

Furthermore, the body-side sealing loop 1131*b* is formed in the upper container body 11 with the elastic material and is configured to fit with the open/close lid-side sealing loop 22 when the open/close lid 2 is closed. As a result, the airtightness of the outlet 1131*a* and the housing space S inside the container body 1 can be improved.

Furthermore, the container body 1 is composed of the upper container body 11 and the lower container body 12, that are connected pivotally on the rear surface. Therefore, by pivoting the upper container body while the container is placed on a table or the like, the housing space S can be opened and the household thin paper sheet P can be refilled.

Therefore, at the time of refill of the household thin paper sheet P, the household thin paper sheet storing container 100 does not need to be lifted but may be left on a table or the like during the refill.

The upper container body 11 and the lower container body 12 are connected to each other at the rear surface, and the upper container body 11 pivots with respect to the lower container body 12 on the connecting portion as a pivot point. In this way, the housing space S can be opened and closed. Therefore, after refilling the household thin paper sheet P and the like, the upper container body 11 and the lower container body 12 can easily fit to each other so that the container body is closed without aligning their positions each time. As a result, it is possible to reduce efforts at the time of refilling the inside household thin paper sheet P.

When the container body 1 is closed, the upper sealing portion 115 formed of an elastic material in the upper container body 11 and the lower sealing portion 121 formed of an elastic material in the lower container body 12 fit to each other, and the airtightness of the container body 1 can be improved. This effect can be particularly enhanced when both the upper sealing portion 115 and the lower sealing portion 121 are made of an elastic material.

Because the nonslip portion 122 made of an elastic material is formed at the lower surface of the container body 1, the container body 1 can be placed more stably on a table or the like.

Modified Embodiment

The button portion 3 does not have to be attached using the button attachment portion 114, as long as the upper container body 11 is provided with the button portion 3 that is movable up and down due to the button moving portion 1132. For example, the button moving portion 1132 may be provided over the entire lower surface of the button portion 3, and then the button portion 3 may be directly adhered and the like and attached to the button moving portion 1132.

Figure 7A:
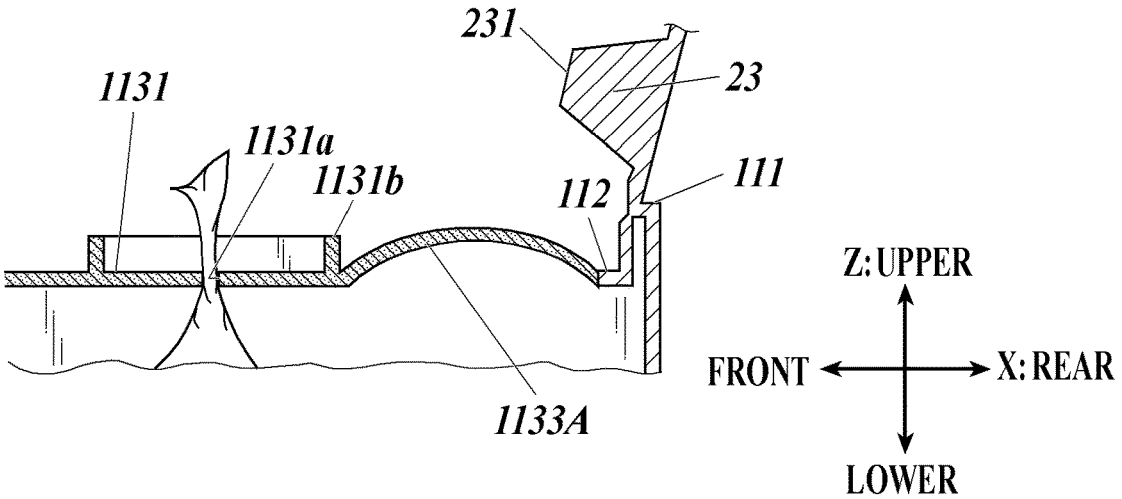
FIG. 7A is a partial cross-sectional view of a household thin paper sheet storing container according to a modified embodiment showing a portion corresponding to FIG. 2.

The specific shape of the open/close lid biasing portion is not limited to the above-mentioned planar film shape. For example, as shown in FIG. 7A, the open/close lid biasing portion 1133A may be formed so as to be convex in the upper direction when the lid is not particularly pushed. In this case, because the open/close lid 2 is deformed greatly when pushed by the biasing projection 23, such that the biasing force on the open/close lid 2 can be strengthened.

The open/close lid biasing portion may not be a single film, but may be formed by combining a plurality of films.

Figure 7B:
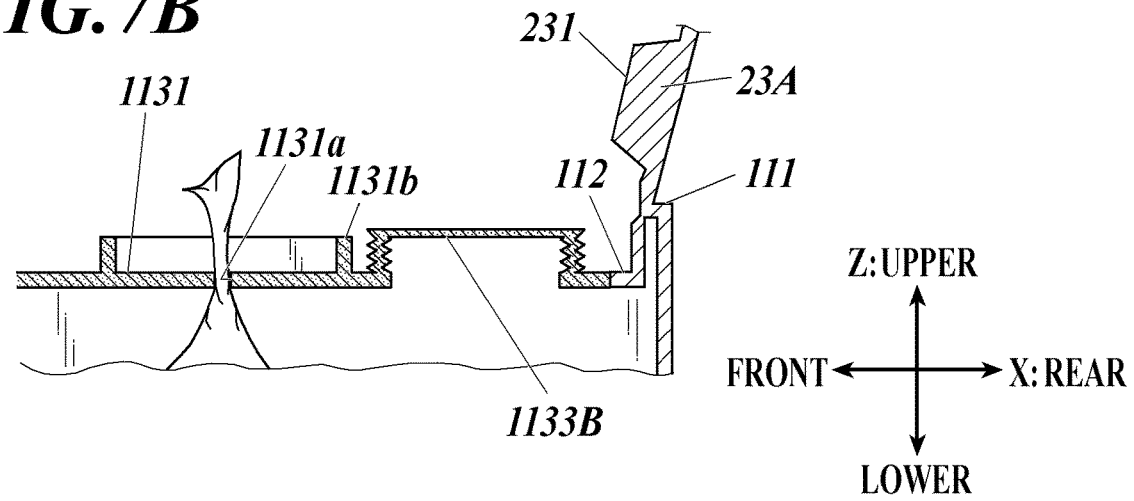
FIG. 7B is a partial cross-sectional view of a household thin paper sheet storing container according to a modified embodiment showing a portion corresponding to FIG. 2.

The open/close lid biasing portion is not limited to have a film shape, but may be a spring that is a bellows-shaped (accordion-folded) elastic material protruding in the upper direction, as the open/close lid biasing portion 1133B shown in FIG. 7B, for example. When the open/close lid 2 is closed, the bellows-shaped open/close lid biasing portion 1133B is pushed by the biasing projection 23A from above, and is folded to become smaller in the upper-lower direction. As a result, the biasing force on the open/close lid 2 is further increased.

In this case, the biasing projection 23A does not need to push the open/close lid biasing portion 1133B below the bottom surface of the recessed portion 112. Therefore, when the open/close lid 2 is closed, the biasing projection 23A may be less deep in the Z direction than the recessed portion 112.

Figure 8:
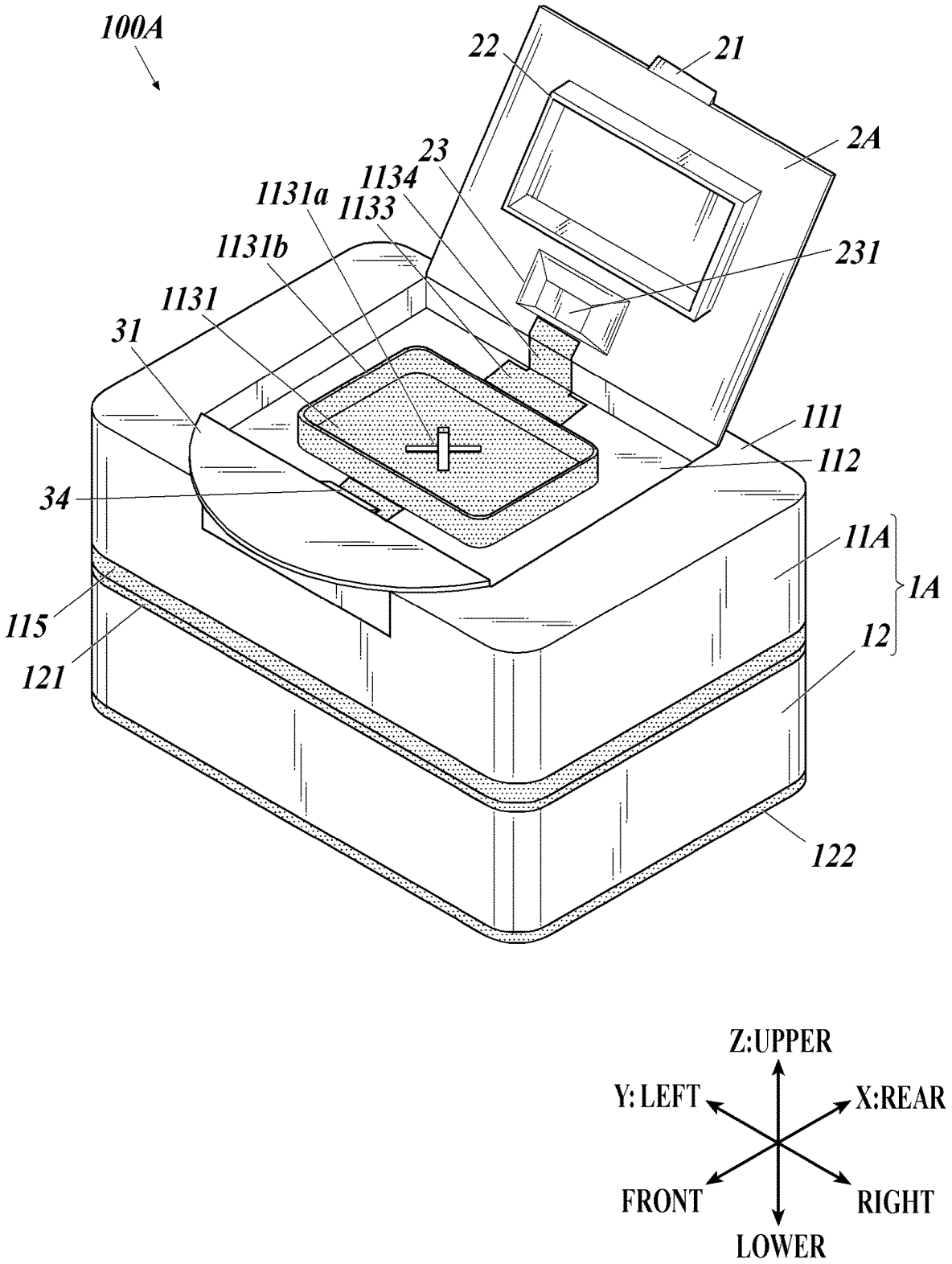
FIG. 8 is a perspective view of a household thin paper sheet storing container according to a modified embodiment viewed diagonally from the front.

Furthermore, as shown in FIG. 8, there may be provided a second open/close lid biasing portion 1134 formed of an elastic material extending from the rear side of the open/close lid biasing portion 1133 of the upper container body 11 to the open/close lid 2A.

The second open/close lid biasing portion 1134 is formed to be stretched when no force is applied thereto as shown in FIG. 8. When the open/close lid 2A is closed and the open/close lid biasing portion 1134 is folded, a force to return to the state shown in FIG. 8 is generated. This makes it possible to bias the open/close lid 2A with respect to the upper container body 11A, so that the open/close lid 2A pivots rearward on the rear connecting portion as a pivot shaft that connects the open/close lid 2A and the upper container body 11A.

Because of the second open/close lid biasing portion 1134 provided in this way, the open/close lid 2A can be biased not only by the above-mentioned open/close lid biasing portion 1133 and the biasing projection 23 but also by the second open/close lid biasing portion 1134. Therefore, it is possible to further strengthen the biasing force on the open/close lid 2 in the opening direction.

Detailed configurations of the household thin paper sheet storing container 100 can be appropriately changed without departing from the gist of the present invention.

The present invention is suitably applied in a technical field of manufacturing a household thin paper sheet storing container.

The invention claimed is:

1. A household tissue paper storing container comprising:

a container body that is configured to store household tissue paper therein and has an outlet through which the household thin paper sheet is taken out;

an open/close lid that is pivotably provided to the container body and is configured to close the outlet;

a latch that latches the open/close lid in a closed state and that, in response to being unlocked, opens the open/close lid; and a biasing portion that biases the open/close lid in an opening direction, wherein the latch includes:

an open/close-lid-side latch portion that is provided at the open/close lid;

a button moving portion that is a flexible portion provided at the container body; and a button portion that is movable up and down by the button moving portion and has a button-side latch portion that is engageable with the open/close-lid-side latch portion, wherein the button moving portion is a film-shaped portion formed of an elastic material provided on an upper surface of the container body, wherein:

the latch includes a button attachment portion that is surrounded by the button moving portion in a plan view, the button attachment portion formed of a hard material and has a body-side fitting portion that having a loop shape and protruding in an upper direction, and the button portion has the button-side latch portion at a rear edge, an upper surface portion that forms an upper surface, and a button-side fitting portion that protrudes from the upper surface portion in a lower direction and fits to the body-side fitting portion.

2. The household thin paper sheet storing container according to claim 1, wherein:

the outlet is formed in an outlet portion that is a flexible portion formed of an elastic material provided on the upper surface of the container body, and the outlet portion is continuous with the button moving portion.

3. The household thin paper sheet storing container according to claim 1, wherein:

the outlet is formed in an outlet portion that is a flexible portion formed of an elastic material provided on the upper surface of the container body, and the outlet portion is continuous with the button moving portion.

4. The household thin paper sheet storing container according to claim 1, wherein the button portion has a front wall that is on a front side of the button-side fitting portion and that protrudes from the upper surface portion in the lower direction.

5. The household thin paper sheet storing container according to claim 4, wherein:

the outlet is formed in an outlet portion that is a flexible portion formed of an elastic material provided on the upper surface of the container body, and the outlet portion is continuous with the button moving portion.

6. The household thin paper sheet storing container according to claim 4, wherein the front wall has an inclined surface on a front side in a vicinity of a lower edge of the front wall, the inclined surface being inclined rearward to a lower part.

7. The household thin paper sheet storing container according to claim 6, wherein:

the outlet is formed in an outlet portion that is a flexible portion formed of an elastic material provided on the upper surface of the container body, and the outlet portion is continuous with the button moving portion.

* * * * *